US006009144A

United States Patent [19]

Ogushi et al.

[11] Patent Number: 6,009,144

[45] **Date of Patent: *Dec. 28, 1999**

[54] X-RAY SYSTEM AND X-RAY EXPOSURE APPARATUS

[75] Inventors: Nobuaki Ogushi; Takayuki Hasegawa, both of Utsunomiya, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/048,126

[22] Filed: Mar. 26, 1998

[30] Foreign Application Priority Data

Mar. 27, 1997 [JP] Japan ..... 9-093223
Mar. 3, 1998 [JP] Japan ..... 10-067763

[51] Int. Cl.[6] ..... G21K 5/00

[52] U.S. Cl. ..... 378/34; 378/160

[58] Field of Search ..... 378/34, 203, 160; 250/505.1, 515.1, 517.1

[56] References Cited

U.S. PATENT DOCUMENTS 5,001,734 3/1991 Uda et al. ..... 378/34
5,285,488 2/1994 Watanabe et al. ..... 378/34
5,448,612 9/1995 Kasumi et al. ..... 378/84
5,581,590 12/1996 Mori et al. ..... 378/34
5,623,529 4/1997 Ebinuma et al. ..... 378/34

*Primary Examiner*—David P. Porta
*Assistant Examiner*—Michael J. Schwartz
*Attorney, Agent, or Firm*—Fitzpatrick, Cella, Harper & Scinto

[57] ABSTRACT

An X-ray system includes a radiation source for producing a radiation beam containing X-rays, a mirror device for reflecting X-rays, a beam duct for introducing the X-rays reflected by the mirror device, to an irradiation zone where an object to be irradiated can be exposed, and a shutter capable of blocking the radiation beam. A protection wall is disposed downstream of the mirror device with respect to the radiation source, for blocking the radiation beam. When the protection wall has a thickness t, the beam duct passing through the protection wall has an opening size a, and the beam duct has a tilt angle θ, there is a relation $(t-t_0)\sin\theta \geqq a$, where $t_0$ is a minimum thickness of the protection wall required to substantially block the radiation beam from a radiation source.

11 Claims, 8 Drawing Sheets

X-RAY SYSTEM AND X-RAY EXPOSURE APPARATUS

FIELD OF THE INVENTION AND RELATED ART

This invention relates to an X-ray system or an X-ray exposure apparatus, or to a device manufacturing method using the same, which is arranged to use X-rays such as radiation light (synchrotron radiation) from a charged particle accumulation ring, for example.

In X-ray exposure apparatuses which use, as exposure light, X-rays such as radiation light from a charged particle accumulation ring (as known as synchrotron radiation), for example, since X-rays or radiation such as γ rays which may be emitted at any disorder of the light source are very harmful to human body, usually dose protection means such as a lead shutter or a radiation protection wall is provided along the path of X-rays to thereby protect operators from being exposed to radiation. An example is disclosed in U.S. Pat. No. 5,581,590.

FIG. 8 shows a known type X-ray exposure apparatus, wherein X-rays emitted from a light source 101 such as a charged particle accumulation ringware reflected by a mirror 102, and they are introduced to an exposure table 103*a* disposed inside an exposure chamber 103. For prevention of attenuation of X-rays by atmosphere, the mirror 102 is mounted within a ultra high vacuum mirror chamber 104, and a beam duct 105 is provided between the light source 101 and the mirror chamber 104. Additionally, between the mirror chamber 104 and the exposure chamber 103, there is another beam duct 106. Ultra high vacuum is maintained within these ducts 105 and 106, like the mirror chamber 104.

The X-rays from the light source 101 pass through the beam duct 105 and enter the mirror chamber 104. Through reflection by the mirror 102, the advancement direction is deflected, and the X-ray beam goes along the beam duct 106. Then, the X-rays goes through an X-ray extraction window 107, made of beryllium film, for example, and, as denoted by an arrow $A_0$, they are introduced into the exposure chamber 103. They pass through a mask on the exposure table 103*a,* and a wafer substrate, for example, is exposed with the X-rays. Mounted between the light source 101 and the mirror chamber 103 is a radiation protection wall 108 having absorptivity to radiation such as γ-rays or neutron rays. Also, for emergency, there is a lead shutter 109 for intercepting the path of X-rays.

When an operator enters the exposure chamber 103 for maintenance of the exposure table 103*a,* for example, the lead shutter 109 has to be first closed to assure that the operator is protected from being exposed to X-rays if, for any reason, X-rays are emitted from the light source 101. For safety, the exposure chamber 103 can not be opened unless the shutter is closed.

SUMMARY OF THE INVENTION

However, this arrangement does not assure full protection to operators. If at disorder of the light source 101 the lead shutter 109 is out of operation or it malfunctions, or, alternatively, it operates too late, there is a possibility that a maintenance operator is exposed to radiation coming straight from the beam duct 106, as depicted by an arrow $B_0$.

It is an object of the present invention to provide an X-ray system or an X-ray exposure apparatus by which the possibility of exposure of an operator for maintenance of an exposure table, for example, to X-rays or radiation rays can be reduced considerably so that high safety is assured.

In accordance with an aspect of the present invention, there is provided an X-ray system, comprising: a radiation source for producing a radiation beam containing X-rays; mirror means for reflecting X-rays; a beam duct for introducing the X-rays reflected by said mirror means, to an irradiation zone where an object to be irradiated can be exposed; a shutter capable of blocking the radiation beam; and a protection wall disposed downstream of said mirror means with respect to said radiation source, for blocking the radiation beam; wherein, when said protection wall has a thickness t, said beam duct passing through said protection wall has an opening size a, and said beam duct has a tilt angle θ, there is a relation $(t-t_0)\sin\theta \geqq a$, where $t_0$ is a minimum thickness of said protection wall required to substantially block the radiation beam from a radiation source.

In accordance with another aspect of the present invention, there is provided an X-ray system, comprising: a radiation source for producing a radiation beam containing X-rays; mirror means for reflecting X-rays; a beam duct for introducing the X-rays reflected by said mirror means, to an irradiation zone where an object to be irradiated can be exposed; a shutter capable of blocking the radiation beam; and a protection wall disposed downstream of said mirror means with respect to said radiation source, for blocking the radiation beam; wherein, when said protection wall has a thickness t, said beam duct passing through said protection wall has an opening size a, said beam duct has a tilt angle θ, and a line extending from a light emission point of said radiation source to said beam duct, passing through said protection wall, and directed to a smallest thickness portion of said protection wall has a tilt angle ø, there is a relation $t \geqq t_0 \cos ø + a \cos ø / \sin(\theta - ø)$, where $t_0$ is a minimum thickness of said protection wall required to substantially block the radiation beam from a radiation source.

The radiation source may preferably comprise a charged particle accumulation ring.

The mirror may preferably include first and second mirrors disposed in this order from said radiation source side, and the protection wall may preferably be disposed between said first and second mirrors.

The X-ray system may preferably further comprise a chamber for accommodating said irradiation zone therein, wherein said chamber may have a locking mechanism which may be openable and closable in response to the operation of said shutter.

In accordance with a further aspect of the present invention, there is provided an X-ray exposure apparatus, comprising: an X-ray system as recited above; and holding means for holding an object to be exposed, at an irradiation zone where the object is to be exposed.

The object to be exposed may be a mask or a wafer.

In accordance with yet a further aspect of the present invention, there is provided a device manufacturing method, comprising the steps of: preparing an X-ray exposure apparatus as recited above; and performing an exposure process by use of the X-ray exposure apparatus.

The device manufacturing method may preferably further comprise a resist coating process before the exposure process, and a development process after the exposure process.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Preferred embodiments of the present invention will be described with reference to the drawings. In the embodiments to be described, the invention is applied to an X-ray system in an X-ray exposure apparatus. However, the present invention is applicable also to an X-ray microscope or an X-ray projection system in the medical field or any other field, for example.

Figure 1:
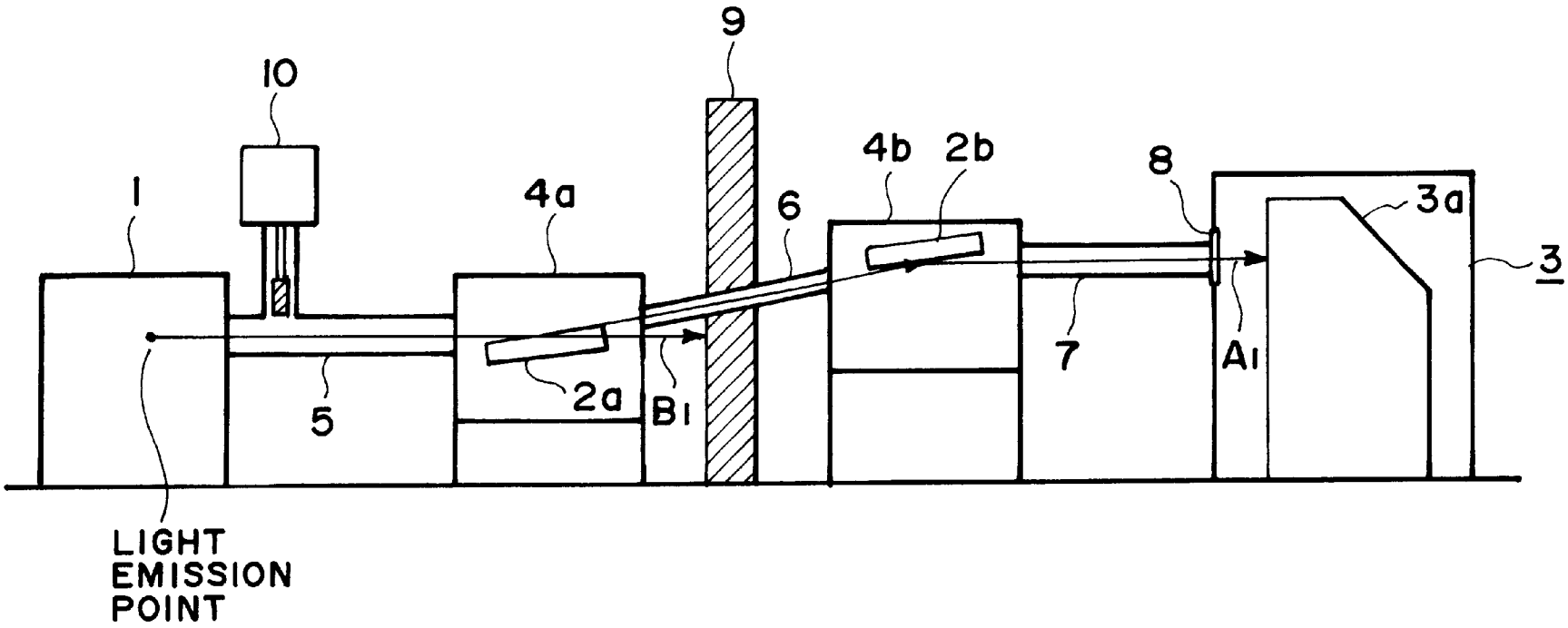
FIG. 1 is a schematic view of an X-ray exposure apparatus according to a first embodiment of the present invention.

FIG. 1 shows an X-ray exposure apparatus according to a first embodiment of the present invention. The exposure apparatus has a beam line as follows. Light source (X-ray radiation source) 1 such as a charged particle accumulation ring, for example, produces X-rays (synchrotron radiation light) which are emitted from a light emission point of the light source. The X-rays are reflected by mirrors 2*a* and 2*b*, sequentially, of first and second reflecting means. The reflected X-rays are introduced into an exposure chamber (closed chamber) 3, and to an exposure table (irradiation zone) 3*a* disposed inside the chamber. The exposure table is equipped with a stage (substrate holding means) by which a mask or a wafer can be held.

The mirrors 2*a* and 2*b* are disposed within first and second ultra high vacuum mirror chambers 4*a* and 4*b*, respectively. Disposed between the light source 1 and the mirror chamber 4*a* is a first beam duct 5, and disposed between the first mirror chamber 4*a* and the second mirror chamber 4*b* is a second beam duct 6. Additionally, a third beam duct 7 is disposed between the second mirror chamber 4*b* and the exposure chamber 3. Like the mirror chambers 4*a* and 4*b*, ultra high vacuum is controlled and maintained inside these beam ducts 5–7.

The X-ray beam from the light source 1 goes along the first beam duct 5 and enters the first mirror chamber 4*a*. After the advancement direction is deflected through reflection by the first mirror 2*a*, the X-ray beam goes along the second beam duct 6 and enters the second mirror chamber 4*b*. After being reflected by the second mirror 2*b*, it goes along the third beam duct 7 and passes through an X-ray extraction window 8. Then, as shown by an arrow $A_1$, it is introduced into the exposure chamber 3 and, after passing a mask on the exposure table 3*a*, it irradiates a wafer substrate, for example, placed on a wafer stage (substrate holding means).

Since γ-rays or neutron rays to be emitted at any disorder of the light source 1 are harmful to the human body, a radiation protection wall 9 for blocking radiation is provided between the first and second mirror chambers 4*a* and 4*b*. Further, a lead shutter 10 is disposed between the light source 1 and the first mirror chamber 4*a*. The exposure chamber 3 is equipped with an opening/closing door having a locking mechanism which is arranged so that the exposure chamber 3 can not be opened (accessed), for maintenance of the exposure table 3*a* in the exposure chamber, for example, by an operator, unless the lead shutter 10 is closed.

As regards the radiation protection wall 9 disposed between the mirror chambers 4*a* and 4*b*, the second beam duct 6 extending through this protection wall is made thin and, additionally, the tilt of the second beam duct 6 with respect to the first beam duct 5 is utilized, so that harmful radiation rays such as γ-rays or neutron rays coming straight from the light source 1, as denoted by an arrow $B_1$, are absorbed by the wall.

Figure 2:
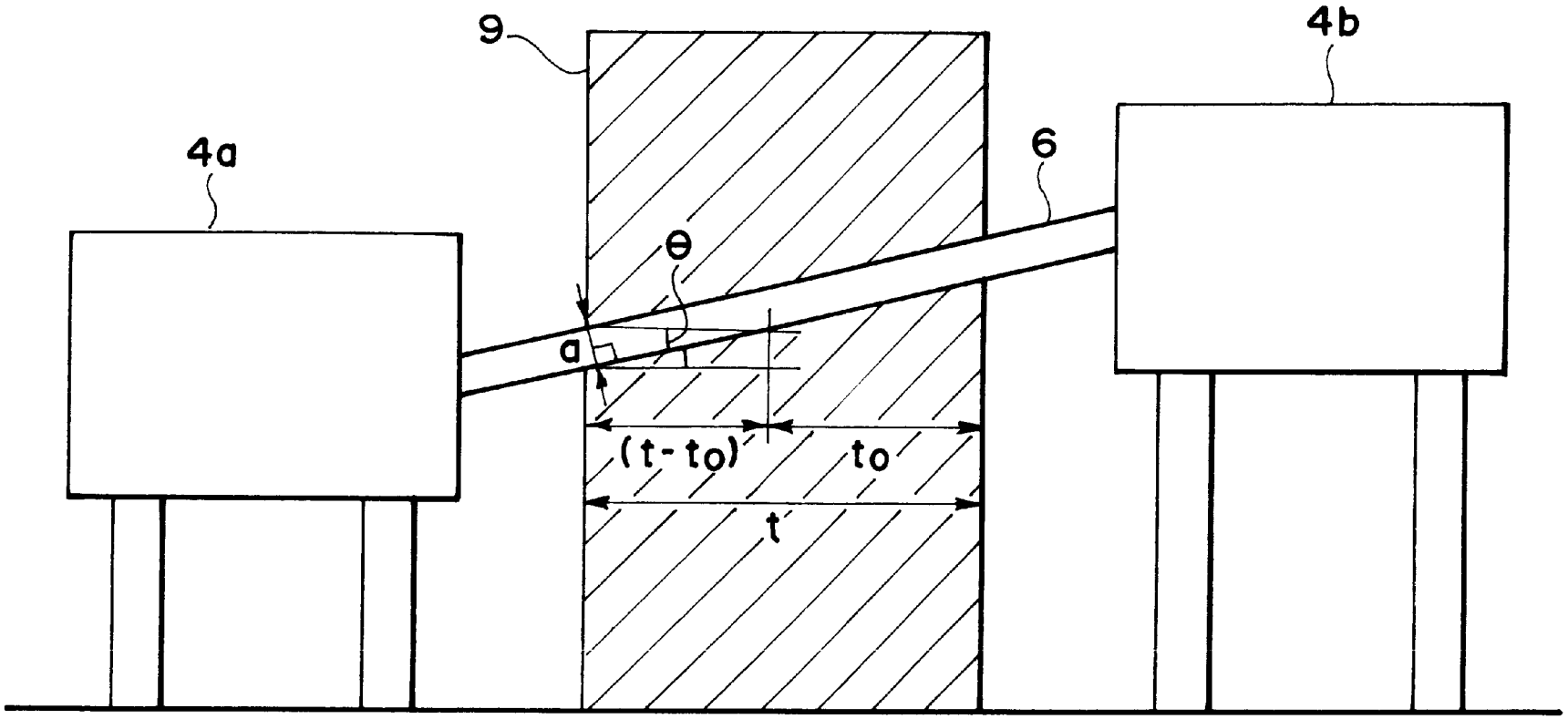
FIG. 2 is a schematic view for explaining the relation among the thickness of a radiation protection wall, the opening size of a beam duct, and the tilt angle thereof.

More specifically, as shown in FIG. 2, where the smallest thickness of the radiation protection wall 9 necessary for blocking the radiation is $t_0$, the second beam duct 6 has an opening size (thickness) a, the tilt angle of the second beam duct 6 relative to the first beam duct 5 is θ, and the radiation protection wall 9 has a thickness t ($t-t_0 \geqq 0$), all the radiation coming straight from the light source 1 can be blocked by the radiation protection wall 9 if the following relation is satisfied:

$$(t-t_0)\sin\theta \geqq a \tag{1}$$

Further, in consideration of a possibility that the radiation emitted from the light emission point of the light source 1 diverges as viewed horizontally, the following condition may preferably be satisfied.

Figure 3:
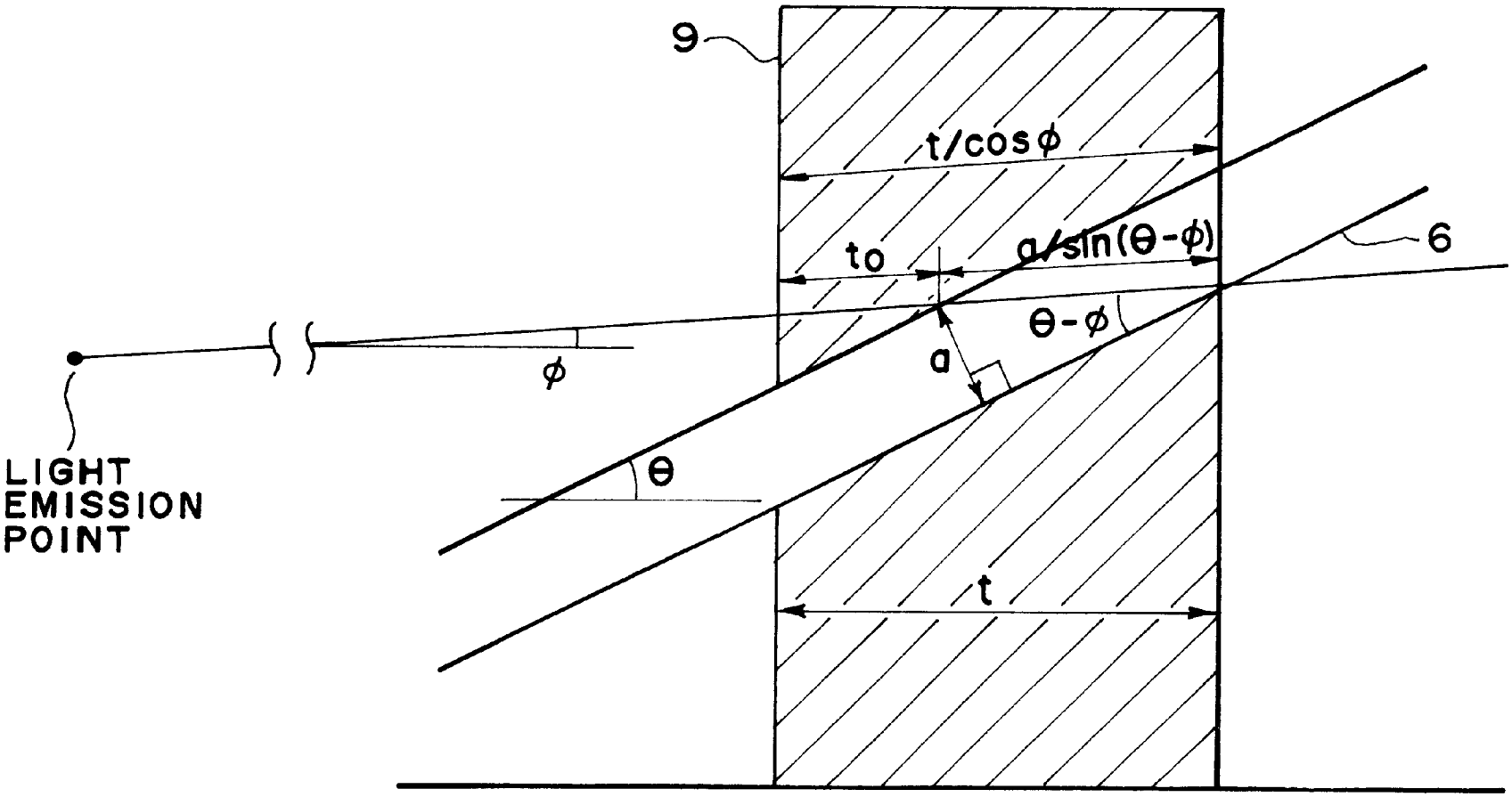
FIG. 3 is a schematic view for explaining the relation among the thickness of a radiation protection wall, a beam duct and a light emission point.

FIG. 3 shows the relation among the radiation protection wall, the beam duct and the light emission point of the light source. As seen in the drawing, if the smallest protection wall thickness required for substantially blocking radiation from the radiation source is $t_0$, the radiation protection wall 9 has a thickness t, the opening size of the beam duct 6 extending through the protection wall is a, the tilt angle of the beam duct 6 with respect to a horizontal plane is 0, and a line that extends from the light emission point of the radiation source to the beam duct 6 passing through the radiation protection wall and being directed to a smallest thickness portion of the radiation protection wall has a tilt angle ø, then any radiation can be fully blocked by the radiation protection wall 9, provided that the following relation is satisfied among them:

$$t \geqq t_0 \cos ø + a \cos ø / \sin(\theta - ø) \tag{2}$$

Here, since the orbit of the charged particle accumulation ring shifts minutely with time, the position of light emission point displaces minutely. The tilt angle ø above represents the angle from a most strict point for the light emission point whose position is variable.

In accordance with this embodiment of the present invention, there is a radiation protection wall provided between the first and second mirrors, for blocking γ-rays or neutron rays. Also, it satisfies the conditions as defined in equations (1) and (2). Thus, the possibility of exposure of an operator to radiation, at any disorder of the light source, is avoided. Additionally, since the exposure table is disposed inside the exposure chamber, there is no possibility of exposure of an operator to X-rays if he/she inattentively accesses the exposure table during the exposure operation. That is, for access to the exposure chamber, first the lead shutter has to be closed and the locking mechanism of the exposure chamber has to be released. This significantly reduces the possibility of exposure of an operator to X-rays during maintenance of the exposure table, for example, inside the exposure chamber.

With the effective combination of accommodation of an exposure table inside an exposure chamber with provision of a radiation protection wall for blocking the radiation, the safety of the X-ray exposure apparatus is improved significantly.

Figure 4:
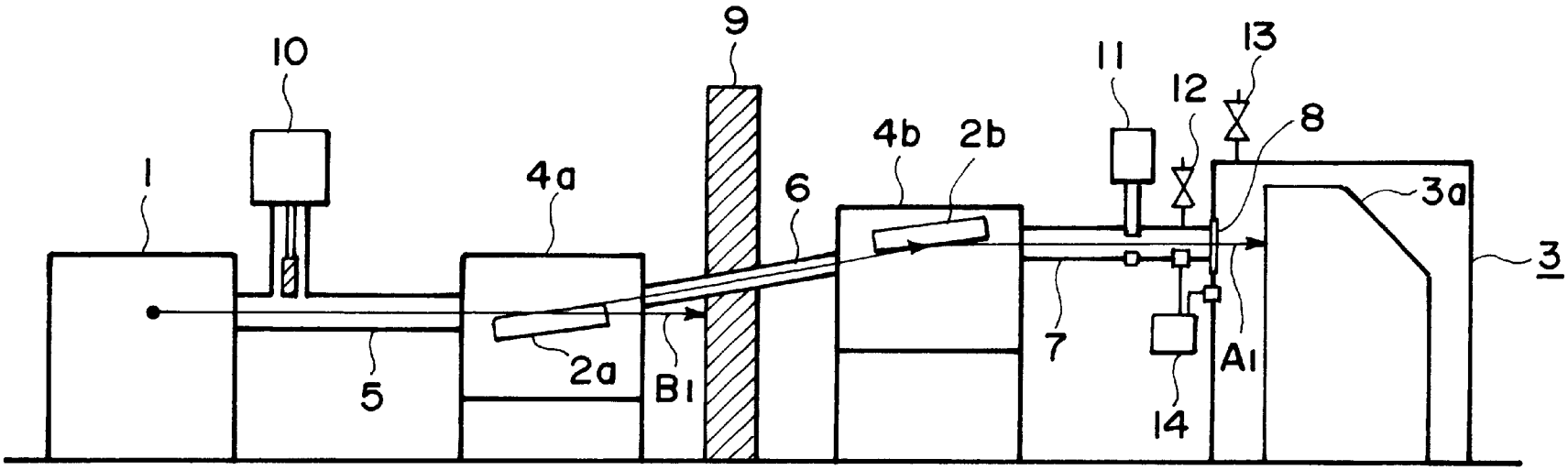
FIG. 4 is a schematic view of a modified form of the first embodiment of the present invention.

FIG. 4 shows a modified form of this embodiment. In this example, a reduced pressure ambience of helium gas, for example, is maintained inside the exposure chamber 3. It is necessary for the X-ray window 8 that it has a strength which bears the differential pressure between the ultra high vacuum within the beam duct and the reduced pressure ambience inside the exposure chamber 3. Thus, the X-ray window 8 can be made considerably thin, as compared with that in the case of atmosphere exposure and, therefore, the X-ray transmissivity can be made higher. As a result, the exposure process can be performed with a larger X-ray intensity than in the case of atmosphere exposure. There is a gate valve 11 added, which serves to prevent breakage of the X-ray window 8, made of a beryllium film, for example, due to application of a large differential pressure thereto as the exposure chamber 3 is opened to atmosphere, for maintenance of the exposure table 3*a,* for example. Before opening the exposure chamber 3, the lead shutter 10 and the gate valve 11 are closed, and atmospheric pressure is introduced from leak valves 12 and 13 to the portions upstream of and downstream of the X-ray window 8. By this, the differential pressure applied to the X-ray window is reduced.

In order to prevent any inconvenience which might be caused at disorder of the gate valve 11 or delay of operation thereof by any malfunction, a differential pressure sensor 14 for detecting the pressure difference between the beam duct 7 and the exposure chamber 3 may be used. The structure may be so arranged that, when the differential pressure at the opposite sides of the X-ray window 8 increases extraordinarily because of any malfunction of the gate valve 11, for example, the leak valves 12 and 13 are opened in response to an output of the differential pressure sensor 14.

At any disorder of the light source, there is no possibility of exposure of an operator to radiation. Additionally, unwanted damage of the X-ray window of beryllium thin film, for example, due to opening of the exposure chamber to atmosphere, can be prevented. Further, if, for any reason, the exposure chamber is opened to atmosphere while the differential pressure sensor 14 or leak valve is out of order, the X-ray window will be broken. In that occasion, however, the vacuum within the beam duct is released and, due to attenuation by atmosphere, X-rays will not reach the exposure chamber. Thus, the worst state of exposure of an operator to radiation can be prevented. The safety of the exposure apparatus is therefore fixed assuredly.

Figure 5:
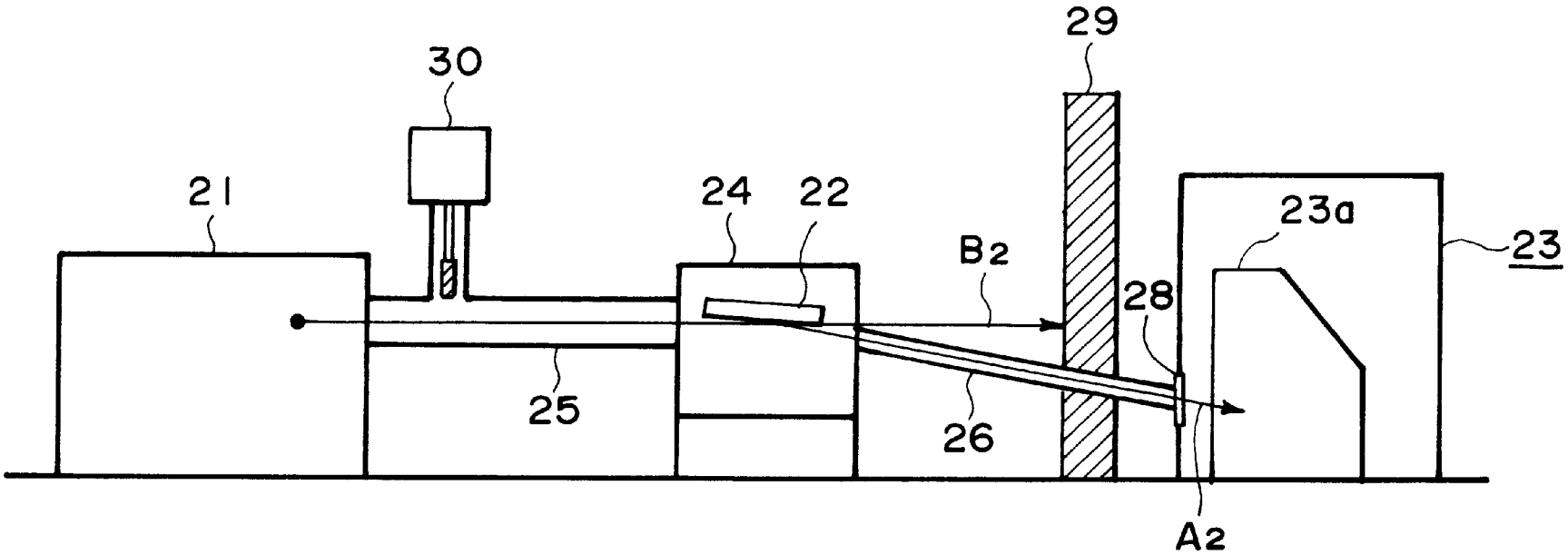
FIG. 5 is a schematic view of an X-ray exposure apparatus according to a second embodiment of the present invention.

FIG. 5 shows a second embodiment of the present invention which uses a single-mirror system. X-rays produced by a light source 21 such as a charged particle accumulation ring, for example, are reflected by a mirror (X-ray reflecting means) 22, and they are introduced to an exposure table 23*a,* disposed inside an exposure chamber 23. The mirror 22 is disposed within an ultra high vacuum mirror chamber 24. There is a beam duct 25 between the light source 21 and the mirror chamber 24. Also, another beam duct 26 is disposed between the mirror chamber 24 and the exposure chamber 23. Like the mirror chamber 24, ultra high vacuum is controlled and maintained inside the beam ducts 25 and 26.

The X-ray beam from the light source 21 goes along the beam duct 25 and enters the mirror chamber 24. After the advancement direction is deflected through reflection by the first mirror 22, the X-ray beam goes along the beam duct 26. Then, it passes through an X-ray window 28 and, as shown by an arrow $A_2$, it is introduced into the exposure chamber 23 which is a closed chamber. After passing a mask on the exposure table 23*a,* it irradiates a wafer substrate, for example.

Since γ-rays or neutron rays to be emitted at any disorder of the light source 21 are harmful to the human body, a radiation protection wall 29 for blocking radiation is provided between the mirror chamber 24 and the exposure chamber 23. Further, there is a lead shutter 30 for intercepting the path of X-rays, at emergency, for example.

The exposure chamber 23 is so arranged that, when an operator accesses the exposure chamber 23 for maintenance of the exposure table 23*a,* for example, the exposure chamber 23 can not be opened unless the lead shutter is closed, such that exposure of the operator to X-rays emitted by any disorder from the light source 21 can be safely prevented.

As regards the radiation protection wall 29, the beam duct 26 extending through this protection wall is made thin and, additionally, the tilt of the beam duct is utilized, such that harmful radiation rays such as γ-rays or neutron rays coming straight from the light source 21, as denoted by an arrow $B_2$, are absorbed by the wall. That is, as in the first embodiment, the thickness of the radiation protection wall is determined to satisfy the relation of equation (1) or (2), among the opening size and tilt angle of the beam duct and the thickness of the radiation protection wall.

Even for an exposure system with a single-mirror system having a single mirror in the beam line, full safety measures for any disorder of the light source can be provided, if the exposure table is accommodated within an exposure chamber and a radiation protection wall for blocking radiation such as γ-rays or neutron rays is provided between the mirror and the exposure chamber.

Next, an embodiment of device manufacturing method which uses an X-ray exposure apparatus such as described above, will be explained.

Figure 6:
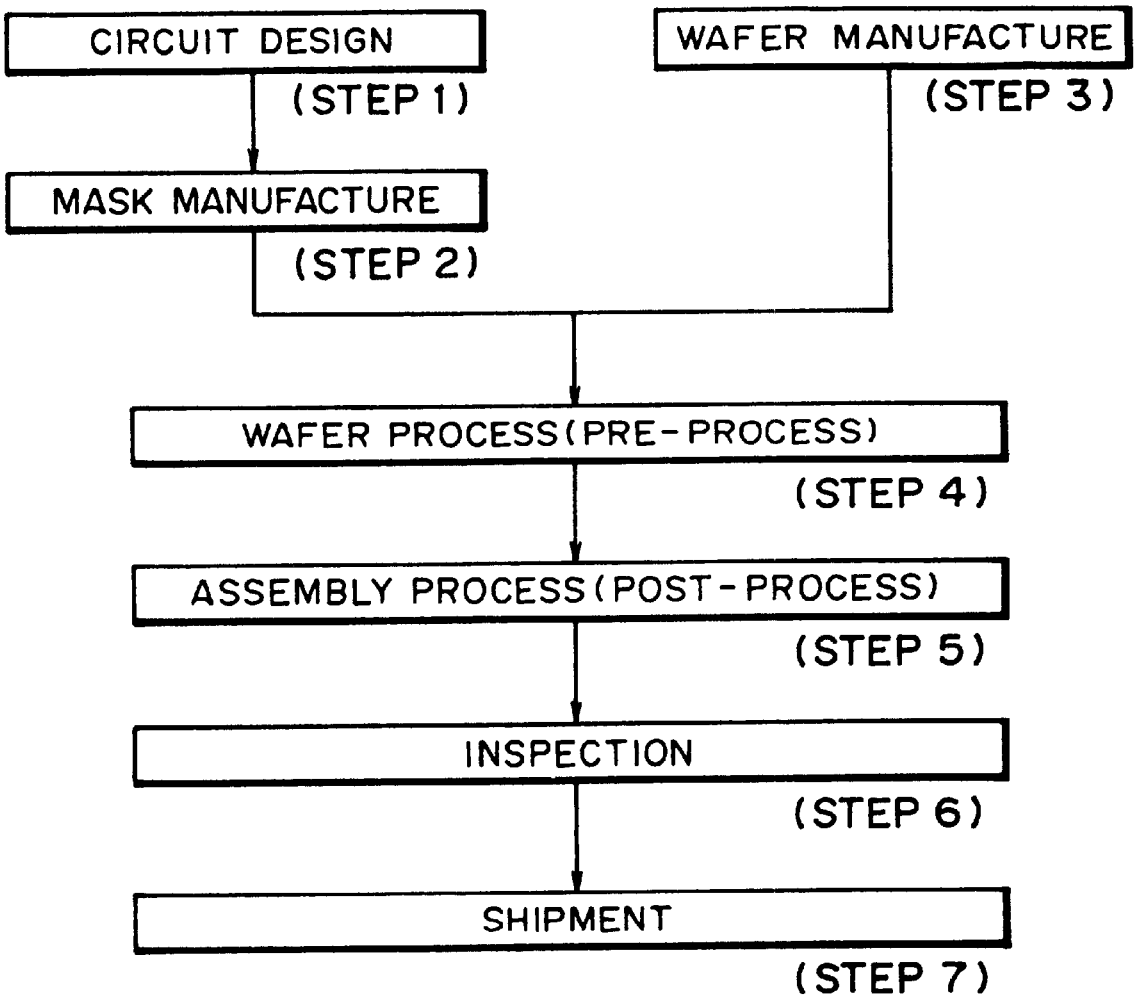
FIG. 6 is a flow chart of semiconductor device manufacturing processes.

FIG. 6 is a flow chart of procedure for manufacture of microdevices such as semiconductor chips (e.g. ICs or LSIs), liquid crystal panels, or CCDs, for example. Step 1 is a design process for designing a circuit of a semiconductor device. Step 2 is a process for making a mask on the basis of the circuit pattern design. Step 3 is a process for preparing a wafer by using a material such as silicon. Step 4 is a wafer process which is called a pre-process wherein, by using the so prepared mask and wafer, circuits are practically formed on the wafer through lithography. Step 5 subsequent to this is an assembling step which is called a post-process wherein the wafer having been processed by step 4 is formed into semiconductor chips. This step includes assembling (dicing and bonding) process and packaging (chip sealing) process. Step 6 is an inspection step wherein operation check, durability check and so on for the semiconductor devices provided by step 5, are carried out. With these processes, semiconductor devices are completed and they are shipped (step 7).

Figure 7:
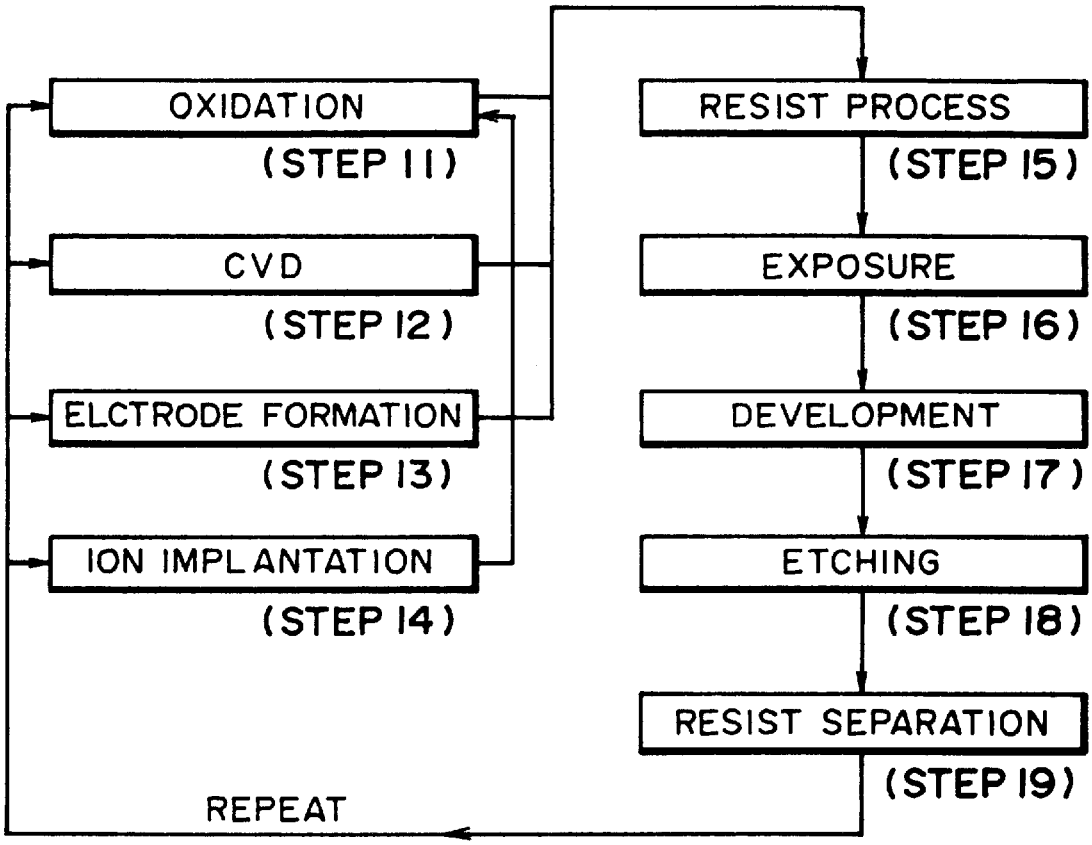
FIG. 7 is a flow chart of a wafer process.
Figure 8:
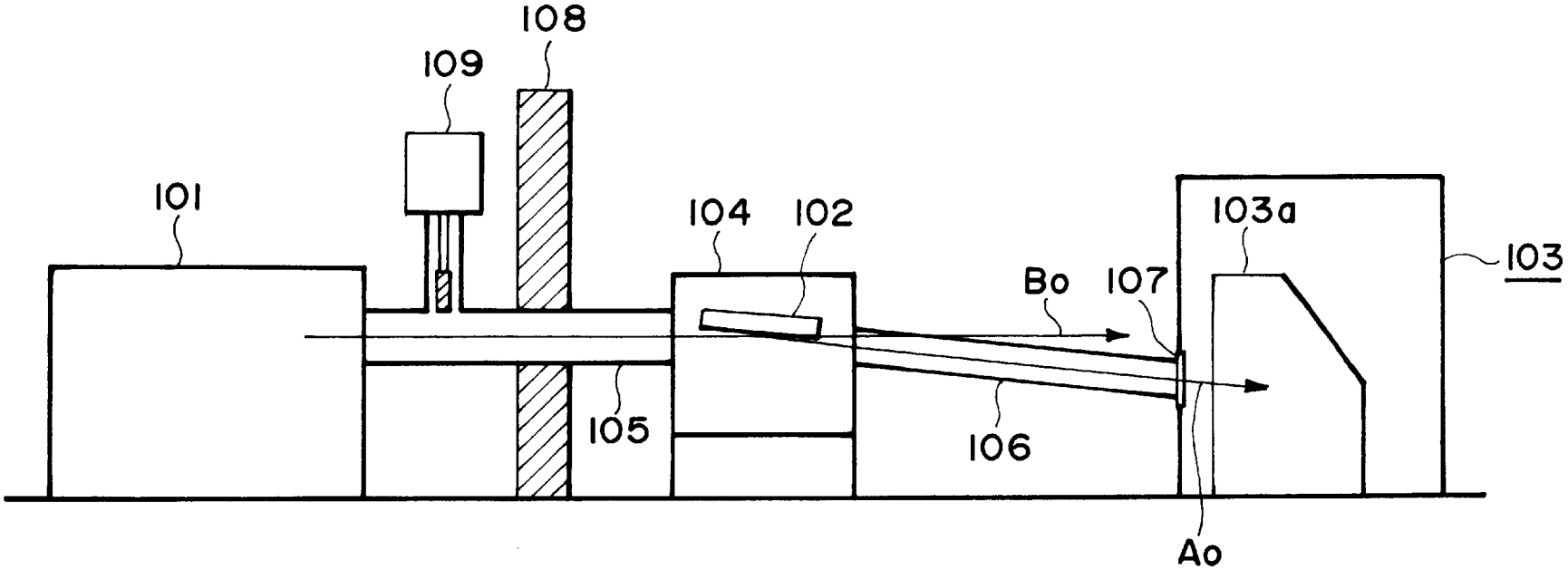
FIG. 8 is a schematic view of a known type of X-ray exposure apparatus.

FIG. 7 is a flow chart showing details of the wafer process. Step 11 is an oxidation process for oxidizing the surface of a wafer. Step 12 is a CVD process for forming an insulating film on the wafer surface. Step 13 is an electrode forming process for forming electrodes upon the wafer by vapor deposition. Step 14 is an ion implanting process for implanting ions to the wafer. Step 15 is a resist process for applying a resist (photosensitive material) to the wafer. Step 16 is an exposure process for printing, by exposure, the circuit pattern of the mask on the wafer through the exposure apparatus described above. Step 17 is a developing process for developing the exposed wafer. Step 18 is an etching process for removing portions other than the developed resist image. Step 19 is a resist separation process for separating the resist material remaining on the wafer after being subjected to the etching process. By repeating these processes, circuit patterns are superposedly formed on the wafer.

While the invention has been described with reference to the structures disclosed herein, it is not confined to the details set forth and this application is intended to cover such modifications or changes as may come within the purposes of the improvements or the scope of the following claims.

What is claimed is:

1. An X-ray system, comprising:

a radiation source for producing a radiation beam containing X-rays;

mirror means for reflecting X-rays;

a beam duct for introducing the X-rays reflected by said mirror means, to an irradiation zone where an object to be irradiated can be exposed;

a shutter capable of blocking the radiation beam; and a protection wall disposed downstream of said mirror means with respect to said radiation source, for blocking the radiation beam;

wherein, when said protection wall has a thickness t, said beam duct passing through said protection wall has an opening size a, and said beam duct has a tilt angle θ, there is a relation $$(t-t_0)\sin\theta \geqq a$$

where $t_0$ is a minimum thickness of said protection wall required to substantially block the radiation beam from a radiation source.

2. An X-ray system, comprising:

a radiation source for producing a radiation beam containing X-rays;

mirror means for reflecting X-rays;

a beam duct for introducing the X-rays reflected by said mirror means, to an irradiation zone where an object to be irradiated can be exposed;

a shutter capable of blocking the radiation beam; and a protection wall disposed downstream of said mirror means with respect to said radiation source, for blocking the radiation beam;

wherein, when said protection wall has a thickness t, said beam duct passing through said protection wall has an opening size a, said beam duct has a tilt angle θ, and a line extending from a light emission point of said radiation source to said beam duct, passing through said protection wall, and directed to a smallest thickness portion of said protection wall has a tilt angle ø, there is a relation $$t \geqq t_0 \cos ø + a \cos ø / \sin(\theta - ø)$$

where $t_0$ is a minimum thickness of said protection wall required to substantially block the radiation beam from a radiation source.

3. A system according to claim 1 or 2, wherein said radiation source comprises a charged particle accumulation ring.

4. A system according to claim 1 or 2, wherein said mirror includes first and second mirrors disposed in this order from said radiation source side, and wherein said protection wall is disposed between said first and second mirrors.

5. A system according to claim 1 or 2, further comprising a chamber for accommodating said irradiation zone therein, said chamber having a locking mechanism which is openable and closable in response to the operation of said shutter.

6. An X-ray exposure apparatus, comprising:

an X-ray system as recited in one of claims 1 and 2; and holding means for holding an object to be exposed, at an irradiation zone where the object is to be exposed.

7. An apparatus according to claim 6, wherein the object to be exposed is a mask or a wafer.

8. A device manufacturing method, comprising the steps of:

preparing an X-ray exposure apparatus as recited in claim 7; and performing an exposure process by use of the X-ray exposure apparatus.

9. A method according to claim 8, further comprising a resist coating process before the exposure process, and a development process after the exposure process.

10. An X-ray system, comprising:

a radiation source for producing a radiation beam containing X-rays;

mirror means for reflecting X-rays;

a beam duct for introducing the X-rays reflected by said mirror means to an irradiation zone where an object to be irradiated can be exposed therewith;

a shutter operable to block the radiation beam; and a protection wall disposed downstream of said mirror means with respect to the radiation beam from said radiation source, for blocking the radiation beam, wherein said protection wall has a thickness which is determined in accordance with a tilt angle of said beam duct.

11. An X-ray system, comprising:

a radiation source for producing a radiation beam containing X-rays;

mirror means for reflecting X-rays;

a beam duct for introducing the X-rays reflected by said mirror means to an irradiation zone where an object to be irradiated can be exposed therewith;

a shutter operable to block the radiation beam; and a protection wall disposed downstream of said mirror means with respect to the radiation beam from said radiation source, for blocking the radiation beam, wherein said protection wall has a thickness t, and wherein, when $t_0$ is a minimum thickness of said protection wall necessary for substantially blocking the radiation beam from said radiation source, a value corresponding to $t-t_0$ is determined in accordance with a tilt angle of said beam duct.

* * * * *